United States Patent [19]

Evans

[11] Patent Number: 4,808,090

[45] Date of Patent: Feb. 28, 1989

[54] VACUUM MOTOR FAN COVER

[75] Inventor: David L. Evans, Rodman, N.Y.

[73] Assignee: The Scott & Fetzer Company, Watertown, N.Y.

[21] Appl. No.: 465,539

[22] Filed: Feb. 10, 1983

[51] Int. Cl.[4] ..... F04B 37/14; F04B 39/12

[52] U.S. Cl. ..... 417/423.2; 417/423.14; 415/119; 415/211

[58] Field of Search ..... 415/211, 219 C, 119; 72/335, 348, 379, 340; 417/424, 360, 361, 423 A, 423 T, 53; 416/DIG. 3; 15/326

[56] References Cited

U.S. PATENT DOCUMENTS

| | | | |
|---|---|---|---|
| 1,708,197 | 4/1929 | Xippas | 418/424 |
| 1,712,698 | 5/1929 | Ginder | 417/424 |
| 2,041,516 | 5/1936 | Rudd | 72/340 |
| 2,148,254 | 2/1939 | Bergstrom | 417/424 |
| 2,183,079 | 12/1939 | Kropp | 415/119 |
| 2,609,596 | 9/1952 | Clark | 72/348 X |
| 3,730,642 | 5/1973 | Barnstead et al. | 417/424 |
| 4,325,149 | 4/1982 | Moreland | 415/219 C |

FOREIGN PATENT DOCUMENTS

| | | | |
|---|---|---|---|
| 1328082 | 8/1973 | United Kingdom | 417/354 |

*Primary Examiner*—Leonard E. Smith
*Assistant Examiner*—Eugene L. Szczecina, Jr.
*Attorney, Agent, or Firm*—Pearne, Gordon, McCoy & Granger

[57] ABSTRACT

A fan cover for a bypass vacuum motor unit is produced by forming outlet apertures in an intermediate flat blank and thereafter deforming the blank into a pan-shaped structure with the outlet apertures disposed on its cylindrical sidewall. The fan cover affords economies in tooling for its manufacture, uniformity in performance, and reduced noise in operation.

4 Claims, 1 Drawing Sheet

VACUUM MOTOR FAN COVER

BACKGROUND OF THE INVENTION

The invention relates to vacuum motor units, and more particularly to a novel and improved fan cover for such units and a method of its manufacture.

PRIOR ART

In a bypass vacuum motor unit, the air flow induced by the fan is separate from air used to cool the electric motor windings. In conventional arrangements, the vacuum fan operates in a cover that establishes a portion of the vacuum air flow circuit. The fan cover, typically, is a pan or cup-shaped structure having a central inlet in its end wall and a plurality of outlet apertures spaced throughout the circumference of its sidewall. These outlet apertures of prior art fan covers customarily have been formed as louvers, where finlike elements project obliquely into and/or out of the cylindrical plane of the fan cover sidewall. The orientation of the louvers ordinarily is conducive to volute air flow out of the fan chamber.

Louvered outlet fan covers are expensive to manufacture because the tooling required to produce them is complex. This complexity is reflected in a high cost of original tooling, relatively high susceptibility to tool wear, and high cost of maintenance for resharpening and other repair of such tooling.

Another disadvantage of the louvered outlet style fan cover is a relatively high degree of variation in performance between vacuum units having fan covers manufactured at different times or on different sets of tooling. It has been found that louvered fan covers manufactured to specified dimensional tolerances, of generally accepted commercial standards, have widely varying performance. This is a disadvantage to the manufacturer of the vacuum motor fan unit because at times, for example, its final product may not meet the specifications of its customer. One source of the variation in performance appears to be burrs at the edges of the louvers adjacent the outlet openings resulting from tooling that, through use, has lost its sharp cutting edges and/or has become misaligned.

A still further disadvantage of the louvered type of fan cover is a characteristically high operating noise level of vacuum motor fan units in which it is employed.

SUMMARY OF THE INVENTION

The invention provides a fan cover in the assembly of a bypass vacuum motor unit that has outlet formations on its periphery which afford, in addition to vacuum performance at least equivalent to prior units, greater uniformity of performance in manufactured parts, lower cost, reduced weight and material content, and, significantly, reduced noise during operation.

The invention goes contrary to conventional practice and contemplates a fan cover having its peripheral outlet path defined as simple apertures blanked or otherwise formed i nthe cylindrical or like plane of its peripheral wall. More specifically, fan covers constructed in this manner, when compared with prior art devices, have demonstrated a surprising level of uniformity of performance between parts within dimensional tolerance but with actual size or geometric difference. Also surprising are the results achieved with the invention in reducing operating noise on otherwise conventional vacuum motor units incorporating the described fan cover.

In the preferred embodiment of the invention, the fan cover is formed from sheet stock, such as galvanized steel. Outlet apertures arranged in an annular pattern are blanked, i.e., punched or otherwise formed in an appropriate area of a blank of sheet stock and, subsequent to formation of such outlet apertures, the fan cover blank is stamped or extruded into a pan shape. In the finished form of the cover, the apertures lie in its cylindrical or near-cylindrical sidewall. A particularly suitable shape for the apertures as they are formed in their original flat blank area is a circle. This circular aperture shape is produced with simple, inexpensive, easily maintained tooling, and avoids sharp corners and associated stress risers which might otherwise induce tearing of the sheet stock when stamped or extruded into the final pan shape. As disclosed, the apertures can be provided in multiple concentric rings on angularly staggered centers. The staggered aperture pattern provides a relatively high collective outlet area, while affording a relatively rigid structure.

DESCRIPTION OF THE PREFERRED EMBODIMENT

Figure 1:
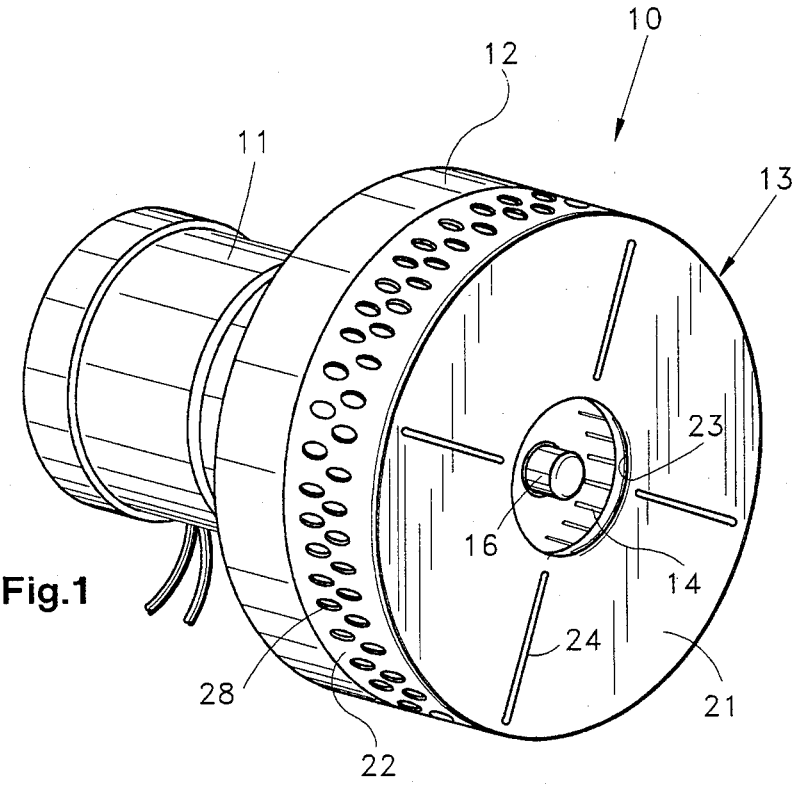
FIG. 1 is a perspective view of a bypass vacuum motor unit incorporating a fan cover constructed in accordance with the invention.

Referring now to the drawing, there is shown a bypass vacuum motor unit 10. A typical application of such a unit in a vacuum cleaner is disclosed, for example, in U.S. Pat. No. 4,315,343 to Neroda et al. The vacuum motor unit 10 includes an electric motor 11, typically of the universal electric type, and of generally conventional construction. An end bell 12 houses the commutator and brushes of the motor 11. A fan cover 13 encloses a fan 14 fixed on a rotary output shaft 16 of the motor 11.

The fan cover 13 is a pan or cup-shaped structure having a generally planar, circular end wall 21 and a generally cylindrical sidewall 22. At its center, the end wall 21 is formed with a circular inlet aperture 23. Radially oriented, angularly spaced stiffening ribs 24 are embossed into the end wall 21 to rigidify it. Ideally, the aperture 23 is formed with an inturned flange 26 and the peripheral edge of the sidewall 22 is formed with a relatively small outward flare 27. The flare 27 facilitates assembly of the cover 13 over the motor end bell 12 and contributes to the structural rigidity of the cover 13. Preferably, the fan cover 13 is retained on the end bell 12 by dimensioning these elements with a relatively snug fit and, after assembly, by staking local annularly spaced areas of the sidewall 22 into the end bell.

Figure 2A:
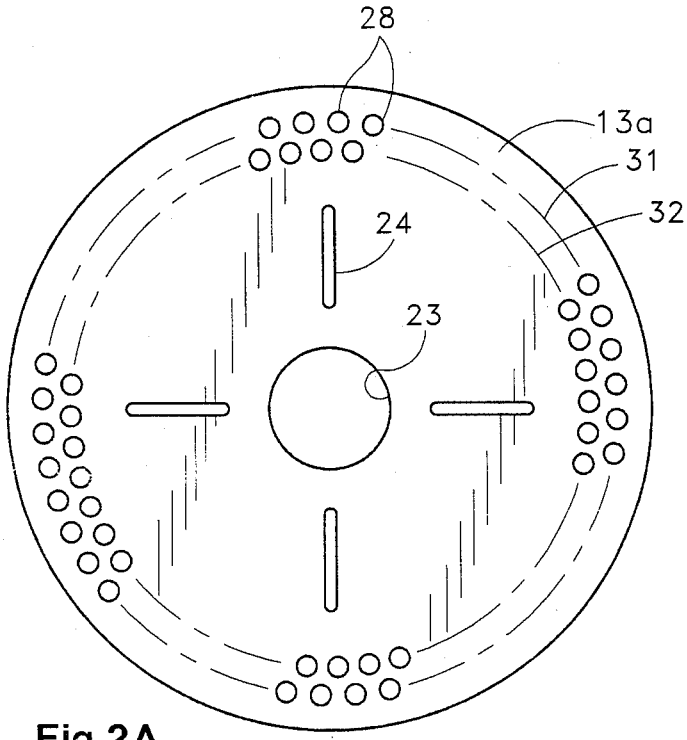
FIG. 2A is a plan view of an intermediate sheet metal blank from which the fan cover of FIG. 1 is ultimately formed.

The fan cover sidewall 22 is provided with a multitude of outlet apertures 28 formed in accordance with the invention. With reference to FIG. 2A, the apertures 28 are ideally formed in the sheet stock making up the fan cover 13 while it is still generally planar, and before the sidewall area is displaced from the plane of the zone of the sheet stock making up the finished end wall 21.

FIG. 2A illustrates an exemplary form of an intermediate fan cover blank 13*a*. A suitable material for the sheet stock fan cover blank is steel preplated with zinc. Preferably, the outlet apertures or holes 28 are cut into the flat fan cover blank 13*a* by a suitable punch and die set in accordance with well known stamping or blanking practices.

Ideally, the apertures 28 in the flat blank 13*a* are circular and are of the same diameter. The apertures 28 are centered on each of two imaginary circles 31, 32 concentric with the center of the fan cover blank 13*a*. On each of the imaginary circles 31,32, the holes are regularly spaced relative to one another. The holes 28 of one circle 31 preferably are disposed on centers midway in an angular sense between the centers of the holes 28 on the other circle 32. Such angular spacing between apertures 28 of different imaginary circles or rows 31,32 enables the apertures to be relatively densely packed while retaining a relatively high rigidity in the final fan cover article 13.

Figure 2B:
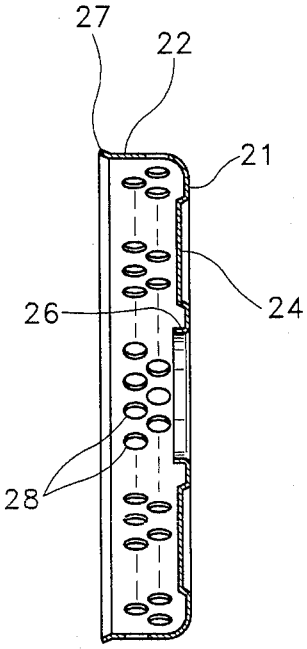
FIG. 2B is a cross-sectional view, taken on a diametral plane, of the fan cover.

The intermediate fan cover blank 13*a* illustrated in FIG. 2A includes the inlet aperture 23, the embossed stiffening ribs 24, the outlet apertures 28, and a definite periphery as structure elements. This blank 13*a*, once formed with these elements, is extruded or stamped, or otherwise formed, into the finished shape of FIGS. 1 and 2B. Ideally, the blank 13*a* is extruded into a pan shape by working it with a female die cavity sized to define the external dimensions of the fan cover 13 and a generally cylindrical male tool or punch sized to define the inside diameter of the finished fan cover. It will be understood by those skilled in the metalworking art that when the flat blank of FIG. 2A is drawn into the pan shape with a simple stamping die set as described, the end wall 21 and sidewall 22 will have generally the same wall thickness (with the sidewall being slightly thinner) and the round apertures will be distorted into elongated or tear-droplike formations.

While this distortion of the apertures appears to have no detrimental effect on the performance of the fan cover 13, there are important advantages in the production of round apertures in the flat blank 13*a*. First, tooling for punching or otherwise cutting the round holes or apertures 28 is simplified in its original form and is relatively easy to maintain in good, i.e., sharp, condition. Second, when the sidewall 22 is deformed or extruded from its originally flat configuration to a cylindrical or near-cylindrical condition, the original round apertures 28 avoid stress points at corners and the like which would otherwise give rise to locations where the metal stock could tear during such deformation.

The intermediate blank 13*a* of FIG. 2A is illustrated for purposes of explanation. It will be understood by those skilled in the metalworking art that, where desired, the ribs 24 and/or inlet aperture 23 can be formed later simultaneously with extrusion of the sidewall 22, or even subsequent to formation of the sidewall. Similarly, the stage at which either the flare 27 or flange 26 is formed is not critical. The disclosed arrangement of the outlet apertures 28, wherein they lie in the cylindrical or near-cylindrical plane of the sidewall 22, has demonstrated, surprisingly, the highly beneficial attributes of uniformity of performance between parts within production tolerances and a reduction in noise levels. Significant variations in performance of prior art bypass vacuum motor units appear to be due, at least in part, to the existence of burrs at their outlet openings. Such burrs can be a source of performance robbing turbulence. In contrast, practice of the present invention tends to eliminate the usual source of such burrs by allowing simple circular hole-cutting tooling to be constructed with precision and by allowing relatively easy resharpening of such tooling.

Another important feature of the invention is that a burr associated with the formation of an outlet aperture 28 and sticking out of the plane of the sheet stock blank 13*a* is removed, flattened, burnished, or otherwise rendered less prominent, when the sidewall 22 is engaged by the tooling used to deform it from its original flat configuration to the cylindrical or near-cylindrical configuration.

Besides uniformity of performance, the fan cover disclosed herein has demonstrated a level of performance at least as good as prior art devices, but which exhibits a surprising reduction in operating noise.

By way of example, a bypass vacuum fan unit incorporating the invention tested under ASTM standards and capable of handling approximately 103 cubic feet per minute with a two-inch orifice at 193 air watts, had a fan cover with the following approximate dimensions:

Material gauge—0.020/0.023 inch thick
Inside diameter of sidewall—5.63 inch
Axial length of sidewall—1.35 inch
Inlet aperture—1.685 inch diameter
Outlet apertures—122 holes in two rows of holes produced by 0.203 inch diameter punch It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A bypass vacuum motor unit comprising an electric motor, a vacuum air flow inducing fan fixed on the shaft of the motor, a pan-shaped fan cover fixed relative to the motor and enshrouding the fan, the fan cover being fabricated from a single sheet of metal stock and having a generally circular end wall and an integral generally cylindrical sidewall, the end wall having a central circular inlet aperture, the sidewall having a plurality of outlet apertures, said outlet apertures being generally curvilinear in form, coplanar with and exclusively in the sidewall, and arranged in a plurality of rows extending circumferentially of the sidewall, the apertures being of sufficient size and number to provide adequate air flow therethrough while being sufficiently restricted in size to limit noise of operation of said unit.

2. A method of making a vacuum unit comprising the steps of fabricating a fan cover from sheet stock, the fabrication of the fan cover including the steps of blanking a plurality of curvilinear outlet holes in the sheet stock in a plurality of circular patterns concentric with the center of the cover, subsequent to the blanking of the outlet holes converting the sheet of stock into a pan-shaped body with the outlet holes lying exclusively in the sidewall of the body, and thereafter attaching the fan cover to a motor housing so as to enclose a fan driven by the motor with the plane of the fan being in alignment with said outlet holes.

3. A method as set forth in claim 2, wherein the outlet holes are worked by tool surfaces during the converting process whereby burrs formed by the blanking of said outlet holes are flattened into the plane of the sidewall of the fan cover.

4. A method as set forth in claim 2, wherein said fan cover is converted into its pan shape by extruding it with a cooperating female die cavity sized to the outside diameter of the sidewall and a male tool sized to the inside diameter of the sidewall.

* * * * *

UNITED STATES PATENT AND TRADEMARK OFFICE

CERTIFICATE OF CORRECTION

PATENT NO. : 4,808,090

DATED : February 28, 1989

INVENTOR(S) : David L. Evans

It is certified that error appears in the above-identified patent and that said Letters Patent is hereby corrected as shown below:

On the cover page, Section [73] Assignee: "The Scott & Fetzer Company" should be changed to --Northland/Scott & Fetzer Company--.

On the cover page, Section [56] References Cited, the Class of the Xippas reference should be changed from "418" to --417--.

Column 3, line 23, delete "structure" and insert --structural--.

Signed and Sealed this

Twenty-sixth Day of September, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,808,090

DATED : February 28, 1989

INVENTOR(S) : David L. Evans

It is certified that error appears in the above-identified patent and that said Letters Patent is hereby corrected as shown below:

On the cover page, Section [73] Assignee: "The Scott & Fetzer Company" should be changed to --Northland/Scott Fetzer Company--.

On the cover page, Section [56] References Cited, the Class of the Xippas reference should be changed from "418" to --417--.

Column 3, line 23, delete "structure" and insert --structural--.

This certificate supersedes Certificate of Correction issued September 26, 1989.

Signed and Sealed this

Third Day of July, 1990

*Attest:*

*Attesting Officer*

HARRY F. MANBECK, JR.

*Commissioner of Patents and Trademarks*